United States Patent [19]

Di Santo et al.

[11] Patent Number: 4,947,157

[45] Date of Patent: Aug. 7, 1990

[54] APPARATUS AND METHODS FOR PULSING THE ELECTRODES OF AN ELECTROPHORETIC DISPLAY FOR ACHIEVING FASTER DISPLAY OPERATION

[75] Inventors: Frank J. Di Santo, North Hills; Denis A. Krusos, Lloyd Harbor, both of N.Y.

[73] Assignee: 501 CopyTele, Inc., Huntington Station, N.Y.

[21] Appl. No.: 252,598

[22] Filed: Oct. 3, 1988

[51] Int. Cl.[5] ..... G09G 3/00

[52] U.S. Cl. ..... 340/787; 340/805; 350/362

[58] Field of Search ..... 340/787, 788, 805; 350/362

[56] References Cited

U.S. PATENT DOCUMENTS 4,041,481 8/1977 Sato ..... 340/787
4,203,106 5/1980 Dalisa ..... 340/787
4,655,897 4/1987 DiSauto et al. ..... 350/362
4,732,830 3/1988 Di Santo et al. ..... 350/333
4,746,917 5/1988 Di Santo et al. ..... 340/787

*Primary Examiner*—Alvin Oberley
*Attorney, Agent, or Firm*—Arthur L. Plevy

[57] ABSTRACT

There is described a method and apparatus for driving an electrophoretic display during a writing mode. During this mode the cathodes that are not being written into are pulsed in regard to the pulsing of a grid that is being written into. The grid that is being written into is associated with a cathode line which line is caused to assume a writing mode for a longer duration than the pulse applied to the writing grid. At the same time cathode lines which are not being written into are pulsed for a time duration equivalent to the time duration of the writing grid pulse. By pulsing the electrodes in the manner described above, one increases the writing speed of the electrophoretic display while maintaining a bright uniform background for the display.

20 Claims, 2 Drawing Sheets

APPARATUS AND METHODS FOR PULSING THE ELECTRODES OF AN ELECTROPHORETIC DISPLAY FOR ACHIEVING FASTER DISPLAY OPERATION

BACKGROUND OF THE INVENTION

This invention relates to electrophoretic display devices in general and more particularly to an apparatus and method for pulsing the electrodes of such a display to enable enhanced speed operation of the display.

As one will ascertain, the electrophoretic effect as employed in display devices is known in the prior art. Basically, the electrophoretic effect operates on the principle that certain particles will become electrically charged and because of being electrically charged these particles can migrate from a like charged surface to an opposite charged surface. Hence, particles which become positively charged will migrate towards a negative surface or terminal or vice versa. As indicated, this effect is well known and display devices have been fabricated utilizing this effect.

For typical examples, reference is made to U.S. Pat. No. 4,732,830 issued on Mar. 22, 1988 and entitled "Electrophoretic Display Panels and Associated Methods" to Frank J. Disanto and Denis A. Krusos, the inventors herein, and assigned to Copytele, Inc., the assignee herein. Reference is also made to U.S. Pat. No. 4,655,897 issued on Apr. 7, 1987 to Frank J. Disanto and Denis A. Krusos, and entitled "Electrophoretic Display Panels and Associated Methods" and also assigned to Copytele, Inc. Reference is also made to U.S. Pat. No. 4,746,917 issued on May 24, 1988 to Frank J. Disanto and Denis A. Krusos, and entitled "Method and Apparatus for Operating an Electrophoretic Display Between a Display and Non-Display Mode".

The above patents give detailed descriptions of the fabrication of such displays as well as the biasing and operation of such displays to enable the electrophoretic effect to be utilized in the production of typical display panels.

In any event, if reference is made to the above noted patents, one will see that such cells or electrophoretic displays essentially contain an anode, a cathode and a grid electrode which grid electrode further controls the transportation of charged particles. In operation, the charged particles are transferred and forced against one electrode, as the anode or cathode under the influence of an applied electric field, so that the viewer may view the color of the pigment which forms a desired display pattern. In this manner the grid electrode is employed to enable control of the migration of such particles. It is also indicated that when the polarity of the field is reversed, the pigment particles are transported and packed on the opposite electrode. This is indicative, for example, of an erasing mode.

As will be further explained, the normal voltages on a typical electrophoretic panel enable the following conditions of operation. The panel can be operated in an Erase Mode where the anode electrode is negative with respect to the cathode electrode which is positive. In this mode the grid electrodes are at a low potential which is equivalent for example to a binary 0. In a Hold Mode the anode is positive, the cathodes are positive and the grid electrodes are essentially at zero voltage or at binary 0 level. As one can understand, the cathode operates between zero and positive voltages while the grid operates between low ("0") and high voltages ("1").

As indicated above, a low condition will be indicated by a binary 0 and a high condition is indicated by a binary 1. In any event, during a Write Mode the anode is positive, the cathodes that are being written into are at zero potential and the grids, which are the writing grids, are at a positive or high potential as a binary 1. During this mode all non-writing cathodes are positive and non-writing grids are at low potential or more negative than the cathode.

In any event, as the prior art was aware of, in order to write at reasonable speeds the grid, during the writing mode, should be held at a positive potential or a high potential which is designated as a binary 1. As one will further understand, by making the grid potential positive one also operates to decrease the background brightness and causes some overwriting in areas where a grid set to 1 intersects a positive cathode line. This will be further explained in conjunction with the specification. In any event, as one will ascertain, the display is formulated by a means of intersecting parallel lines which are insulated from each other. These lines form an XY matrix or an XY array and consist of grid lines and cathode lines arranged in a matrix. Hence, to access any particular point in a matrix, one must have an X and a Y address. The X and Y address is indicated by one grid line and one cathode line which intersect to form a pixel point or area and which point or area is written by causing pigment particles to migrate out of that pixel area on said display.

At the intersection of the X and Y addresses in the matrix, one will thereby provide a writing condition. In any event, as indicated above, when the grid potential becomes positive there is a decrease in the background brightness of the display due to the fact that the potential between the grid and cathode has changed for non-writing lines.

In addition, and of greater consequence, a dark line will appear at the leading edge of the picture being written (corresponding to the cathode at zero potential). The black line is indicative of the fact that all the pigment has left the cathode in the pixels being written. This is desirable, however, it is also noted that when the potential of the cathode being written into is made positive, some of the pigment returns to the cathode resulting in incomplete writing and poor contrast. It is believed that this effect is probably due to the fact that the negatively charged pigment, which has only gone a short distance beyond the grid, is attracted back to the cathode by the combined positive grid and cathode fields. These factors substantially decrease the writing speed of such a display and provide a lack of contrast and so on, as described above.

It is the object of the present invention to apply selectable pulses to the grid and cathode electrodes during a write mode whereby the pulses supplied will serve to maintain the grid to cathode potential of non-writing electrodes at a fixed value which is indicative of a good contrast level. At the same time, a writing pulse applied to the grid remains for a given duration while the cathode to be written is held low for a longer duration. In this manner, one will have a positive grid potential at the start of writing a given pixel and a negative grid (which will repel the pigment that has traveled to the anode side of the grid) when writing of that pixel (cathode from zero to positive potential) is complete. In this manner, as will be explained, the effective speed of operation of the display is dramatically increased and results in a speed increase of approximately 6:1 over a conventional display operated according to the teachings of the prior art.

It is further indicated that the apparatus and method to be provided also pulses all cathodes which are not being written by a pulse of the same nature as the writing grid pulse. In this manner, the potential between the non-writing cathode lines and the grid lines remains constant and hence the above-noted problems are avoided.

BRIEF DESCRIPTION OF THE PREFERRED EMBODIMENT

Apparatus for driving an electrophoretic display in a write mode, which display is of the type having a plurality of grid lines insulated from a plurality of cathode lines with said grid and cathode lines positioned perpendicular to one another to provide an X-Y matrix. Said display having an anode electrode, said display enabling a picture to be displayed on said cathode by selectively accessing intersecting grid and cathode lines each indicative of a pixel and varying the bias between said lines to cause said particles to migrate to said anode for each selected intersection. The improvement in connection therewith comprising means coupled to said grid lines to provide a grid pulse on said lines, to be written of a given duration and of a given polarity and amplitude indicative of a write bias for said grid lines, means coupled to a selected intersecting cathode line associated with said grid line and selected according to a pixel to be written to provide a cathode pulse to said cathode line of an opposite polarity to said grid pulse and commencing at the start of said grid pulse but having a longer duration than said given duration whereby said cathode pulse is present when said grid pulse terminates. Apparatus for pulsing all non-writing cathodes with a pulse of the same amplitude and duration as the grid pulse.

DETAILED DESCRIPTION OF THE DRAWINGS

Figure 1:
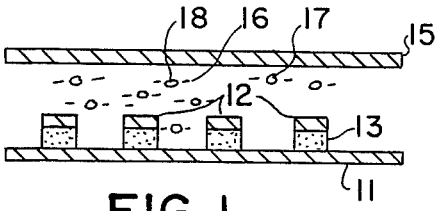
FIG. 1 is a simple schematic view depicting an electrophoretic display according to this invention.

Referring to FIG. 1 there is shown a simple schematic diagram necessary to indicate operation of a typical electrophoretic display. The reference numeral 11 refers to a cathode electrode which, as one will see from the above noted patents, is one of a number of a series of lines which are arranged, for example, in the horizontal or X direction. Each of these lines, as cathode lines, can be accessed or biased by means of a separate voltage applied to such a line. The associated grid lines are represented by reference numeral 12. Each grid structure, four of which are shown in FIG. 1, is insulated from the cathode lines by means of an insulator layer 13. The plate, or anode electrode, is referenced in FIG. 1 by reference numeral 15. In order to access a point on the matrix a potential is applied between the grid and cathode lines. This potential will access an intersection point in the X-Y matrix indicative of a pixel. In any event, the electrophoretic dispersion 16, which is located between the anode and cathode, contains a plurality of submicron pigment particles which can be charged according to known techniques.

The grid array, as indicated, overlies the cathode array and is insulated therefrom. When a given potential is applied between an X and Y point in the matrix, electrophoretic particles which are within the vicinity of the intersection between the grid and cathode structures are accelerated towards the anode. Particles, as 17 and 18, as indicated by the arrows, deposit on the plate or anode electrode and remain there until the charge or bias is reversed.

As one can ascertain from the above described prior art, the movement of the particles, as controlled by the intersection between an X and a Y line, causes these particles to migrate towards the anode. Thus, if the grid to cathode potential is properly selected, electrophoretic particles which are negatively charged will be attracted towards the positive anode 15 which will assume the color of the pigment particles.

An image is formed on the cathode. The cathode image being a dark color, which is the color of the suspension medium in which the particles are suspended. As one can understand, the pigment particles are suspended in an electrophoretic dispersion and essentially are yellow particles in certain embodiments with the dispersion medium having a dark blue color. Thus, by viewing the cathode surface, either a yellow image on a dark blue background or a dark blue image on a yellow background may be viewed.

Figure 2:
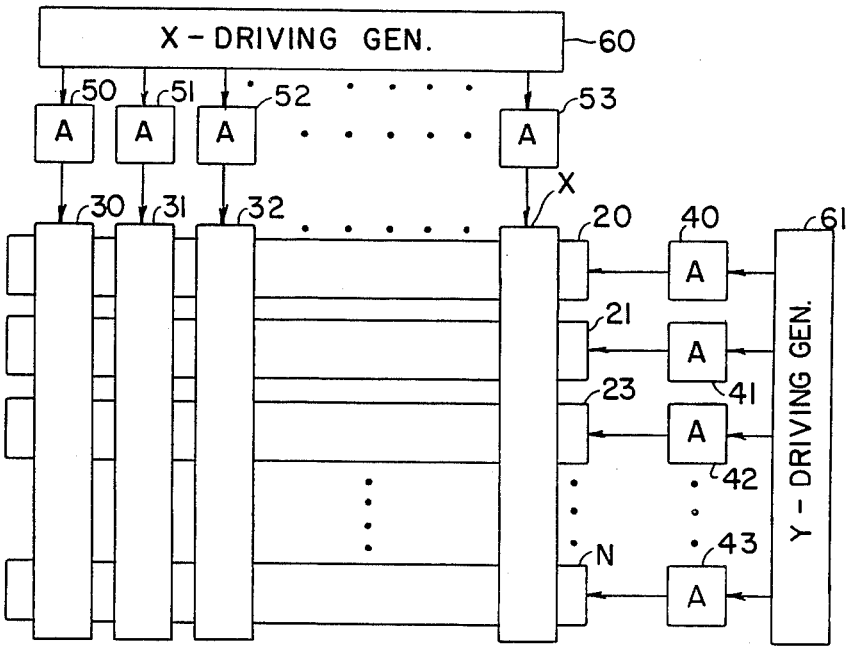
FIG. 2 is a schematic diagram showing an XY matrix array consisting of intersecting grid and cathode lines as provided in the electrophoretic display.

Referring to FIG. 2 there is shown a top view of a typical X-Y matrix consisting of cathode lines which are arranged in the horizontal plane and grid lines which are perpendicular to the cathode lines and which are insulated therefrom. Thus, referring to FIG. 2, there is shown four cathode lines designated as 20, 21, 22 and N. It is of course understood that the number of cathode lines in the Y direction may consist of hundreds or thousands, depending upon the size of the display.

As indicated, insulated from the cathode lines and perpendicular thereto, there are shown four grid lines 30, 31, 32 and X. It is also indicated that there can be many more grid lines associated with a typical display.

As seen in FIG. 2, each cathode line has a suitable driving amplifier circuit shown in modular form and indicated by reference numerals 40, 41, 42 and 43. In a similar manner, each grid line has a suitable driving amplifier referenced by modules 50, 51, 52 and 53. The driving signals for the grid and cathodes are obtained by typical driving generators as 60 and 61. As will be explained, these generators are such that they will provide the type of pulses necessary for the improved operation, as will be described in conjunction with the timing diagrams.

As indicated above, the display can typically be operated in an Erase Mode, a Hold Mode or a Writing Mode. In the Erase Mode the anode electrode, which is not shown in FIG. 2, is placed at a negative potential while the cathodes as lines 20-N are operated at a positive potential. In this mode the grid lines as 30 to X are operated at a low potential such a negative potential designated as zero for purposes of this discussion. In the hold mode the anode is positive while the cathodes are held positive and the grids are again at a low potential. As one can understand from the above, the cathode operates between zero and positive voltages. The grid operates between low and high voltages and for purposes of the present discussion a low will be indicative of zero and a high would be indicative of a 1.

In the Write Mode, the anode is held positive while cathode lines which are being written are placed at zero potential while non-writing cathodes are placed at positive potential. This is the same potential as employed in the Hold Mode. In this manner the writing grids are operated at a high potential and the non-writing grids are operated at the low potential or zero potential. This is exactly what the prior art taught in order to achieve the writing operation.

Based on prior art operation and looking at FIG. 2, the following problems occur. First let us assume that one desires to write at the intersection of cathode line 20 with grid line 30. In this manner grid line 30, via the driver amplifier 50, would be placed at the high or positive level. The cathode line 20, by means of the driver amplifier 40, would be set to a zero or ground potential. All other cathode lines, as 21, 23 and N would be set at a positive potential while all other non-writing grids, such as 31, 32 and X, would be set at the low potential. When the grid 30 has a positive potential applied thereto, an overwriting occurs between the intersections of grid 30 and cathode lines 21, 23 and N. As one can ascertain, the existence of the positive potential on the grid line 30 changes the cathode to grid voltage for lines 21, 23 and N. This causes an overwriting in each of these areas. This overwriting, essentially, reduces the effective contrast of the display.

In addition, and as indicated above, a dark line appears at the leading edge of the picture being written which corresponds to the cathode line 20 being at zero potential. Hence when the grid 30 is made positive a black line or an extremely black area appears at the intersection of cathode line 20 and grid line 30. This black line is indicative of the fact that all the pigment has left the cathode in the indicated area intersection between grid line 30 and cathode line 20. In any event, when the potential of the cathode line 20, which is being written, is made positive some of the pigment returns to the cathode area resulting in incomplete writing and poor contrast. As indicated above, this is probably due to the fact that the negatively charged pigment, which has only gone a short distance beyond the grid electrodes, is attracted back to the cathode by the combined positive grid and cathode fields. The amount returned is a function of writing speed.

Thus, as will be explained, in order to solve this problem it is indicated that the amplifiers as for example 50, 51, 52 and 53 will be operated so that there is a positive grid potential at the start of writing a given pixel and a negative grid potential which will repel the pigment that has traveled to the anode side of the grid when writing of that pixel as for example when the cathode goes from zero to positive potential and therefore when the writing of that pixel is complete. Furthermore, the circuit will also operate to pulse all cathodes not being written in a positive potential direction and for a time duration exactly the same as the duration of the grid pulse. In this manner, all lines which are not being written maintain the same voltage difference between grid and cathode and hence do not degrade the brightness of the non-written areas. The cathode line that is being written is pulsed from a positive to a zero value for a duration longer than the duration of the grid pulse. In this manner the above-described problems have been substantially reduced.

Figure 3:
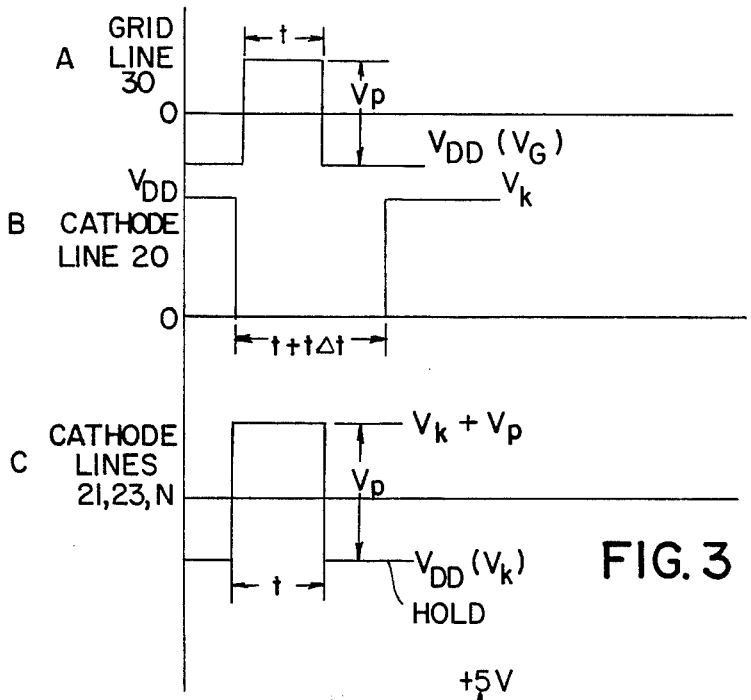
FIG. 3(A–C) is a series of timing diagrams showing the pulsing techniques according to this invention.

For examples of typical timing diagrams, reference now will be made to FIG. 3. FIG. 3 shows the necessary timing relationships and waveforms for pulsing the grid and cathode electrodes according to the teachings of this invention. Referring to FIG. 3 there is shown three wave forms (A, B, C) indicative of the waveforms provided by the driving amplifiers and driving generators as 60 and 61 of FIG. 2 during the write mode. Let us assume, for example, that we are about to access the intersection between cathode line 20 and grid line 30. As shown in FIG. 3A, the grid line 30 will go from a given value, called $V_{dd}(V_G)$ to a positive value, thus exhibiting a positive peak of VP and for a duration of t seconds.

The waveform of FIG. 3B shows that cathode line 20 goes from $V_{DD}$ $(V_K)$ which is the hold voltage to zero or ground and remains for a duration of $t+\Delta t$ or for a longer duration than the pulse applied to the grid line 30. After the duration of $t+\Delta t$ cathode line 20 returns to the level $V_{DD}(V_k)$ At the same time the cathode lines as 21, 23 and N which are those lines that are not being written are pulsed with a transition from the $V_{DD}$ voltage which is the Hold voltage in a positive direction to go to a level of $V_k+V_p$ where $V_p$ is the same as $V_p$ in FIG. 3A. The time duration of the cathode line pulse, time t, is the same as the duration of the grid pulse of FIG. 3A.

Thus, as explained, the above waveforms prevent the above-described problems whereby the cathode to grid potential of all cathode lines which are not being written into remains the same due to the pulsing of the non-writing cathode lines as shown in FIG. 3 as well as keeping the writing cathode at ground for a longer duration than the writing grid pulse.

Thus, the writing cathode line is held at zero potential for a longer duration than the positive pulse duration applied to the writing grid and non-writing cathodes therefore preventing the above-described problem whereby charged pigment will not be attracted back to the cathode by the combined positive grid and cathode fields as would be accomplished in the prior art. It is of course understood that one can write into multiple grid lines for each cathode line. In any event, if this occurs the same pulse configuration is generated by the circuitry for each of the grid lines to be written into in regard to the single cathode line as line 20 and the pulses having the time durations as depicted in the figure are appropriate.

In a typical display the following voltages were applicable. The voltage $V_G$ was equal to $-5$ volts, the voltage $V_k$ was equal to $+19$ volts, the voltage pulse $V_p$ equals the $+10$ volts. The hold voltage, which is $V_k-V_g$ was 24 volts while the grid transition went from $-5$ volts or from $V_G$ to $+5$ volts indicative of a 10 volt peak (VP). The non-writing cathode transition is from $V_k$ equal to $+19$ volts to $V_k+V_p$ equal to $+29$ volts. The duration of the grid pulse t is dependent upon the writing time for a particular line. Essentially one can write one line in 4 milliseconds whereby t would approximately equal 3 milliseconds with $\Delta t$ equal to 1 millisecond.

In a similar manner, if one had a maximum writing time say of 10 milliseconds or more, t would be equal to 7 or 8 milliseconds while $\Delta t$ would be 2 or 3 milliseconds or more. It is indicated that for writing times which exceed 10 milliseconds the duration of pulse t would stay at 7 or 8 milliseconds while the remaining time, Δt, would vary accordingly.

Figure 4:
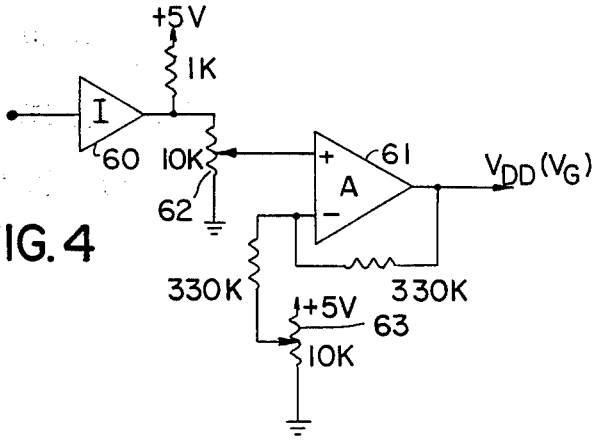
FIG. 4 is a schematic diagram showing a grid drive amplifying circuit employed in conjunction with this invention.

Referring to FIG. 4 there is shown a typical grid driving amplifier such as employed for amplifiers 50, 51, 52 and 53. Essentially the amplifier has an input to driver 60 which is synchronous to the cathode scan and of a suitable width as described above in FIG. 3. It should be apparent to those skilled in the art that there are many techniques available for providing such pulses which are essentially as shown in FIG. 3.

The output of the driver 60 is coupled to a potentiometer 62 which is suitably biased and serves as the input to the operational amplifier 61 which also has a biasing adjustment coupled thereto. The potentiometers 62 and 63 are utilized to set the effective DC levels which are applied to the grid in regard to the pulse as shown for example in FIG. 3A.

In regard to FIG. 4 the driver stage 60 is implemented using an 7407 while the operational amplifier 61 is an MC4741. The driving amplifier is a DC amplifier to maintain the grid lines at a suitable level when writing does not occur.

Figure 5:
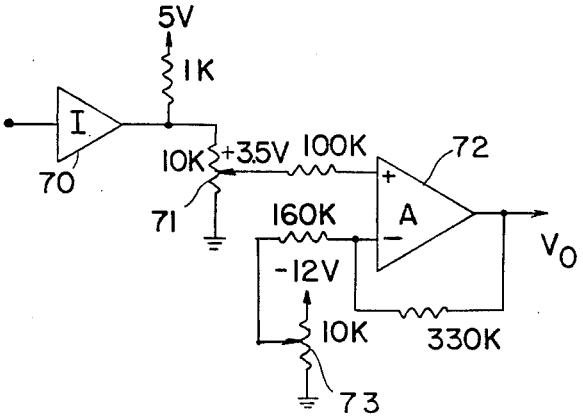
FIG. 5 is a schematic diagram showing a cathode drive amplifying circuit according to this invention.

Referring to FIG. 5 there is shown a schematic of the DC cathode amplifiers as for example amplifiers 40, 41, 42 and 43 of FIG. 2. Each cathode amplifier has a driver input stage 70 which receives an input the same as the input to driver 60 in FIG. 4. The output of the driver 70 is coupled via a potentiometer 71 to the input of an operational amplifier 72 which also has its biasing adjusted by means of potentiometer 73. In this manner the output of the operational amplifier 72 is implemented to provide the pulse and DC levels as shown and necessary to drive the corresponding cathode lines as indicated in FIGS. 3B and C.

In regard to the schematic shown in FIG. 5, the inverter is also a 7404 integrated circuit while the operational amplifiers is an LM-2900. In view of the above, it should be apparent to those skilled in the art that the technique of driving the grid and cathode lines as described above enables faster display operation while circumventing many of the problems indicated above as associated with prior art displays and driving techniques.

We claim:

1. Apparatus for driving an electrophoretic display in a write mode, which display is of the type having a plurality of grid lines insulated from a plurality of cathode lines with said grid and cathode lines positioned perpendicular to one another to provide an X-Y matrix, and said display having an anode electrode, said display enabling a picture to be displayed on said cathode by selectively accessing intersecting grid and cathode lines each indicative of a pixel and varying the bias between said lines to cause said particles to migrate to said anode for each selected intersection, the improvement in connection therewith comprising:

means coupled to said grid line to provide a grid pulse on said line of a given duration and of a given polarity and amplitude indicative of a write bias for said grid line;

means coupled to a selected intersecting cathode line associated with said grid line and selected according to a pixel to be written and to provide a cathode pulse to said cathode line of an opposite polarity to said grid pulse and commencing at the start of said grid pulse but having a longer duration than said given duration whereby said cathode pulse is present when said grid pulse terminates.

2. The apparatus according to claim 1 wherein said given duration is between 3 to 8 milliseconds, with said longer duration being between 4 to 20 milliseconds.

3. The apparatus according to claim 1 further including means coupled to said cathode lines of said display indicative of non-writing pixel locations as intersecting with said grid line for applying a pulse of said given duration to each of said non-writing cathode lines and of a polarity and amplitude to maintain a preset bias between said grid lines and said non-writing cathode lines.

4. The apparatus according to claim 1 wherein said means coupled to said grid line includes means for placing a given polarity DC level on said line, with said grid pulse starting at said DC level and directed therefrom in a positive direction.

5. The apparatus according to claim 4 wherein said given polarity DC level is a negative DC level with said pulse starting at said negative level and going to a positive polarity.

6. The apparatus according to claim 4 wherein said means coupled to .said cathode line includes means for placing a given polarity DC level on said cathode line opposite in polarity to said grid polar polarity with said cathode pulse starting at said DC level on said cathode line and going negative from said level.

7. The apparatus according to claim 3 wherein said pulse applied to said non-writing cathode line is of the same polarity and duration as said pulse applied to said selected grid line.

8. The apparatus according to claim 5 wherein said means coupled to said grid line includes a DC amplifier having an output,-for providing said DC level and an input for receiving said grid pulse.

9. The apparatus according to claim 6 wherein said means coupled to said cathode line includes a DC amplifier having an output for providing said DC level and an input for receiving said cathode pulse.

10. A method of applying writing potentials to an electrophoretic display of the type having a plurality of cathode lines intersecting with and insulated from a plurality of transverse grid lines to form an X-Y matrix with an anode electrode positioned with respect to said matrix to receive electrophoretic particles which are caused to migrate to said anode according to biases placed on said matrix by selecting intersections of a grid and cathode line indicative of a pixel during a writing operation, comprising the step of:

placing a pulse of a given duration and a first polarity on a selected grid line indicative of one address of said pixel;

placing a pulse of a greater duration and an opposite polarity on a selected cathode line indicative of the second address of said pixel, whereby said pulse on said selected cathode line is present when said pulse on said selected grid line terminates to cause said grid line to assume a given polarity when writing of that pixel as selected is complete.

11. The method according to claim 10 further comprising the step of:

placing a pulse of said given duration on all cathode lines intersecting said grid line which are not selected and of a polarity to maintain the grid to cathode bias of said non-selected pixels at a predetermined level during the time said selected pixel is accessed.

12. The method according to claim 10 further comprising the steps of:

placing a fixed DC bias of a given polarity on said grid line from which said pulse is directed;

placing a fixed DC bias of an opposite polarity to said given polarity upon said cathode line from which said cathode pulse is directed.

13. The method according to claim 12 wherein said fixed DC level placed on said grid line is a negative DC level.

14. The method according to claim 12 wherein said fixed DC level as placed on said cathode line is a positive DC level.

15. A method for applying writing potentials to the electrodes of an electrophoretic display of the type having a plurality of cathode lines intersecting with and insulated from a plurality of transverse grid lines to form an X-Y matrix, with an anode electrode positioned with respect to said matrix to receive electrophoretic particles according to biases placed on said matrix, where each X-Y intersection of said matrix is indicative of a pixel which is selected by a grid line address and a cathode line address, comprising the steps of:

placing a pulse of a given duration on a selected grid line indicative of one address of said pixel, placing a pulse of a greater duration on a selected cathode line indicative of a second address of said pixel; and placing pulses of said given duration on all other cathode lines intersecting said grid line and not indicative of said selected pixel, with each of said pulses starting at the same time.

16. The method according to claim 15 further including the steps of:

placing a fixed DC bias of a given polarity on said grid line from which bias level said grid pulse is directed;

placing a fixed DC bias of opposite polarity to said given polarity on said cathode line from which said cathode pulse is directed.

17. The method according to claim 16 wherein said fixed DC bias on said grid line is a negative DC bias.

18. The method according to claim 16 wherein said fixed DC bias on said cathode line is a positive DC bias.

19. The method according to claim 15 wherein said grid pulse is a positive pulse of said given duration which said greater duration pulse being a negative pulse and with said pulse on said other cathode lines being a positive pulse of said given duration.

20. The method according to claim 19 wherein said grid pulse and said other cathode pulses are relatively of the same pulse amplitude.

* * * * *